US008097222B2

(12) United States Patent
Scurati

(10) Patent No.: US 8,097,222 B2
(45) Date of Patent: Jan. 17, 2012

(54) MICROFLUIDIC DEVICE WITH INTEGRATED MICROPUMP, IN PARTICULAR BIOCHEMICAL MICROREACTOR, AND MANUFACTURING METHOD THEREOF

(75) Inventor: Mario Giovanni Scurati, Milan (IT)

(73) Assignee: STMicroelectronics, S.r.l., Agrate Brianza (IT)

( * ) Notice: Subject to any disclaimer, the term of this patent is extended or adjusted under 35 U.S.C. 154(b) by 516 days.

(21) Appl. No.: 11/914,125

(22) PCT Filed: May 10, 2006

(86) PCT No.: PCT/EP2006/062224

§ 371 (c)(1), (2), (4) Date: Jun. 25, 2008

(87) PCT Pub. No.: WO2006/120221

PCT Pub. Date: Nov. 16, 2006

(65) Prior Publication Data

US 2009/0214391 A1 Aug. 27, 2009

(30) Foreign Application Priority Data

May 12, 2005 (EP) ..... 05425314

(51) Int. Cl.
*B01L 3/00* (2006.01)

(52) U.S. Cl. ..... 422/505; 422/502; 422/68.1; 137/14; 137/833; 216/41; 216/2; 216/11; 216/46; 216/51; 435/278; 435/288.5; 435/303.1

(58) Field of Classification Search ..... 422/68.1, 422/99, 100, 102, 103, 104; 137/14, 833; 216/41, 2, 11, 46, 51, 39; 435/278.2, 288.5, 435/303.1

See application file for complete search history.

(56) References Cited

U.S. PATENT DOCUMENTS 4,993,143 A 2/1991 Sidner et al.

(Continued)

FOREIGN PATENT DOCUMENTS

WO WO9725531 7/1997

(Continued)

OTHER PUBLICATIONS de Boer, Meint J., et al., Micormachining of buried micro channels in silicon. Journal of Microelectromechanical systems 9:94-102 (2000).

(Continued)

*Primary Examiner* — In Suk Bullock
*Assistant Examiner* — Sharon Pregler
(74) *Attorney, Agent, or Firm* — Boulware & Valoir

(57) ABSTRACT

A microfluidic device for nucleic acid analysis includes a monolithic semiconductor body (13), a microfluidic circuit (10), at least partially accommodated in the monolithic semiconductor body (13), and a micropump (11). The microfluidic circuit (10) includes a sample preparation channel (18) formed on the monolithic semiconductor body (13) and at least one microfluidic channel (20, 22) buried in the monolithic semiconductor body (13). The micropump (11), includes a plurality of sealed chambers (40) provided with respective openable sealing elements (41) and having a first pressure therein that is different from a second pressure in the microfluidic circuit (10). In addition, the micropump (11) and the microfluidic circuit (10) are configured so that opening the openable sealing elements (41) provides fluidic coupling between the respective chambers (40) and the microfluidic circuit (10). The openable sealing elements (41) are integrated in the monolithic semiconductor body (13).

21 Claims, 13 Drawing Sheets

U.S. PATENT DOCUMENTS 5,429,734 A 7/1995 Gajar et al.
5,637,469 A 6/1997 Wilding et al.
5,639,423 A 6/1997 Northrup et al.
5,856,174 A 1/1999 Lipshutz et al.
5,922,591 A 7/1999 Anderson et al.
5,939,312 A 8/1999 Baier et al.
5,942,443 A 8/1999 Parce et al.
6,046,056 A 4/2000 Parce et al.
6,093,330 A * 7/2000 Chong et al. ..... 216/2
6,116,863 A 9/2000 Ahn et al.
6,168,948 B1 1/2001 Anderson et al.
6,261,431 B1 7/2001 Mathies et al.
6,267,858 B1 7/2001 Parce et al.
6,283,718 B1 9/2001 Prosperetti et al.
6,376,291 B1 4/2002 Barlocchi et al.
6,379,929 B1 4/2002 Burns et al.
6,394,759 B1 5/2002 Parce
6,403,367 B1 6/2002 Cheng et al.
6,453,928 B1 * 9/2002 Kaplan et al. ..... 422/103
6,521,188 B1 2/2003 Webster
6,664,104 B2 12/2003 Pourahmadi et al.
6,670,257 B1 12/2003 Barlocchi et al.
6,673,593 B2 1/2004 Mastromatteo et al.
6,710,311 B2 3/2004 Villa et al.
6,727,479 B2 4/2004 Villa et al.
6,752,601 B2 6/2004 Takeuchi et al.
6,770,471 B2 8/2004 Barlocchi et al.
6,830,936 B2 12/2004 Anderson et al.
6,864,071 B2 3/2005 Carrino et al.
7,013,033 B2 3/2006 Arena et al.
2001/0036672 A1 * 11/2001 Anderson et al. ..... 436/180
2002/0022261 A1 2/2002 Anderson et al.
2002/0060156 A1 5/2002 Mathies et al.
2002/0068357 A1 6/2002 Mathies et al.
2004/0096964 A1 5/2004 Mastromattteo et al.
2004/0132059 A1 7/2004 Scurati et al.
2004/0141856 A1 7/2004 Scurati
2004/0227207 A1 11/2004 Barlocchi et al.

FOREIGN PATENT DOCUMENTS

WO WO0188525 11/2001

OTHER PUBLICATIONS

Voigt, P., et al., Electrofluidic full-system modeling of a flap valve micropump based on Kirchhoffian network theory. Sensors and Actuators 66:9-14 (1998).

* cited by examiner

MICROFLUIDIC DEVICE WITH INTEGRATED MICROPUMP, IN PARTICULAR BIOCHEMICAL MICROREACTOR, AND MANUFACTURING METHOD THEREOF

CROSS REFERENCE TO RELATED APPLICATIONS

This application is a 35 U.S.C. Section 371 of PCT/EP2006/062224 filed May 10, 2006, which claims priority to European Application No. EP 05425314.1 filed May 12, 2005.

FIELD OF THE INVENTION

The invention relates to a microfluidic devices with integrated micropump and to a manufacturing method thereof. In particular, the invention may be advantageously exploited in integrated microreactors, such as microreactors for nucleic acid analysis.

BACKGROUND OF THE INVENTION

Typical procedures for analyzing biological materials, such as nucleic acid, protein, lipid, carbohydrate, and other biological molecules, involve a variety of operations starting from raw material. These operations may including various degrees of cell separation or purification, cell lysis, amplification or purification, and analysis of the resulting amplification or purification product.

As an example, in DNA-based blood analyses samples are often purified by filtration, centrifugation or by electrophoresis so as to eliminate all the non-nucleated cells, which are generally not useful for DNA analysis. Then, the remaining white blood cells are broken up or lysed using chemical, thermal or biochemical means in order to liberate the DNA to be analyzed. Next, the DNA is denatured by thermal, biochemical or chemical processes and amplified by an amplification reaction, such as PCR (polymerase chain reaction), LCR (ligase chain reaction), SDA (strand displacement amplification), TMA (transcription-mediated amplification), RCA (rolling circle amplification), and the like. The amplification step allows the operator to avoid purification of the DNA being studied because the amplified product greatly exceeds the starting DNA in the sample.

If RNA is to be analyzed the procedures are similar, but more emphasis is placed on purification or other means to protect the labile RNA molecule. RNA is usually copied into DNA (cDNA) and then the analysis proceeds as described for DNA.

Finally, the amplification product undergoes some type of analysis, usually based on sequence or size or some combination thereof. In an analysis by hybridization, for example, the amplified DNA is passed over a plurality of detectors made up of individual oligonucleotide detector fragments that are anchored, for example, on electrodes. If the amplified DNA strands are complementary to the oligonucleotide detectors or probes, stable bonds will be formed between them (hybridization). The hybridized detectors can be read by observation using a wide variety of means, including optical, electromagnetic, electromechanical or thermal means.

Other biological molecules are analyzed in a similar way, but typically molecule purification is substituted for amplification, and detection methods vary according to the molecule being detected. For example, a common diagnostic involves the detection of a specific protein by binding to its antibody.

Such analysis requires various degrees of cell separation, lysis, purification and product analysis by antibody binding, which itself can be detected in a number of ways. Lipids, carbohydrates, drugs and small molecules from biological fluids are processed in similar ways. However, we have simplified the discussion herein by focusing on nucleic acid analysis, in particular DNA analysis, as an example of a biological molecule that can be analyzed using the devices of the invention.

The steps of nucleic acid analysis described above are currently performed using different devices, each of which presides over one part of the process. In other words, known equipment for nucleic acid analysis comprises a number of devices that are separate from one another so that the specimen must be transferred from one device to another once a given process step is concluded.

To avoid the use of separate devices, an integrated device must be used, but even in an integrated device the biological material specimen must be transferred between various treatment stations, each of which carries out a specific step of the process described above. In particular, once a fluid connection has been provided, preset volumes of the specimen and/or reagent species have to be advanced from one treatment station to the next.

To this aim, various types of micropumps are used. However, existing micropumps present a number of drawbacks. For example, in the most commonly used micropumps a membrane is electrically driven so as to suction a liquid in a chamber and then expel it. Inlet and outlet valves ensure a one-way flow. Membrane micropumps suffer, however, from the fact that they present poor tightness and allow leakage. In addition, the microfluidic valves also leak and are easily obstructed. Consequently, it is necessary to process a conspicuous amount of specimen fluid because a non-negligible part thereof is lost to leakage. In practice, it is necessary to have available several milliliters of specimen fluid in order to obtain sufficient material for analysis. The use of large amounts of specimen fluid is disadvantageous both on account of the cost and because the processing times, in particular the duration of the thermal cycles, are much longer. In any case, imperfect tightness is clearly disadvantageous in the majority of applications and not only in DNA analysis equipment.

Other types of pumps, such as servo-assisted piston pumps or manually operated pumps, present better qualities of tightness, but currently are not integratable on a micrometric scale. Further common defects in known micropumps are caused by direct contact with the specimen undergoing analysis, which may give rise to unforeseeable chemical reactions, and high energy consumption.

EP-A-1 403 383 discloses a micropump formed in a first body of semiconductor material and comprising a plurality of fluid-tight chambers. The chambers have been sealed under predetermined low pressure or vacuum conditions and may be opened by electronically breaking the seal. The micropump is bonded on a second body, which accommodates an integrated biochemical microreactor and includes a microfluidic circuit filled with a biological sample. The micropump is arranged so that the chambers are fluidly coupled with the microfluidic circuit, once the seals have been removed. Since the pressure inside the chambers is lower than the external pressure, the biological sample is sucked toward the micropump. Sequentially opening the chambers thus results in controlled movement of the biological sample step by step along the microfluidic circuit. The volume of each chamber, the pressure level therein and the timing of the opening determine the flow of the biological sample.

The micropump of EP-A-1 403 383 may be bonded to microfluidic devices and overcomes any leakage problems. However, a separate semiconductor body and a separate manufacturing process are required, so that the micropump is still expensive and rather bulky. Moreover, bonding a finished micropump to a separate body incorporating a finished microfluidic circuit involves some critical matters, such as exact alignment of inlets of the vacuum chambers with ports of the microfluidic circuit. Misalignments may prevent fluidic connection between the (opened) vacuum chambers and the microfluidic circuit, thereby causing a failure of the microfluidic device.

BRIEF SUMMARY OF THE INVENTION

The aim of the present invention is to provide a microfluidic device that is free from the above described drawbacks.

According to the present invention, a microfluidic device and a manufacturing process thereof are provided, as defined in claims 1 and 19, respectively.

BRIEF DESCRIPTION OF THE DRAWINGS

For a better understanding of the present invention, some embodiments thereof are now described, purely by way of non-limiting example, and with reference to the attached drawings, wherein.

DETAILED DESCRIPTION OF EMBODIMENTS OF THE INVENTION

The invention can be advantageously used in numerous applications, whenever it is necessary to move fluids through microfluidic devices. Hereinafter, reference will be made to DNA analysis devices, without this, however, limiting thereby the scope of the invention. In fact, the micropump can be employed with the analysis of any biological or chemical specimen.

Figure 1:
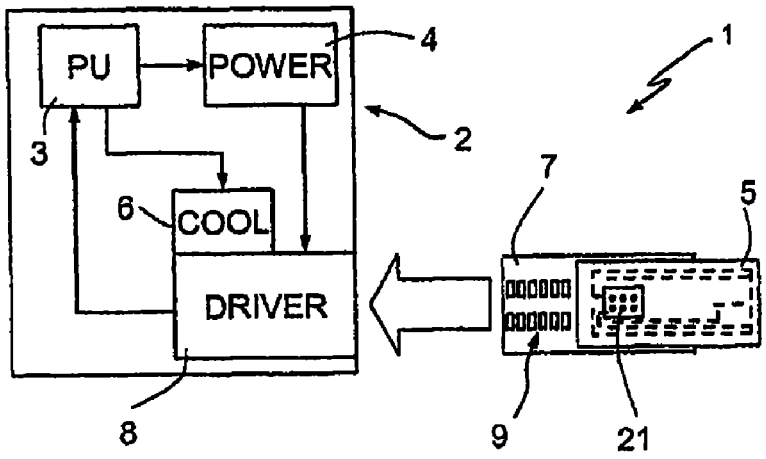
FIG. 1 is a simplified block diagram of a biochemical analysis apparatus including a microfluidic device according to a first embodiment of the present invention.

With reference to FIG. 1, a biochemical analysis apparatus 1 comprises a computer system 2, including a processing unit 3 (PU), a power source 4 controlled by the processing unit 3, and a microreactor 5. The microreactor 5 is mounted on a board 7, which is removably inserted in a driver device 8 of the computer system 2, for selective coupling to the processing unit 3 and to the power source 4. To this end, the board 7 is also provided with an interface 9. The driver device 8 also includes a cooling element 6, e.g. a Peltier module or a fan coil, which is controlled by the processing unit 3 and is coupled to the microreactor 5 when the board 7 is loaded in the driver device 8.

Figure 2:
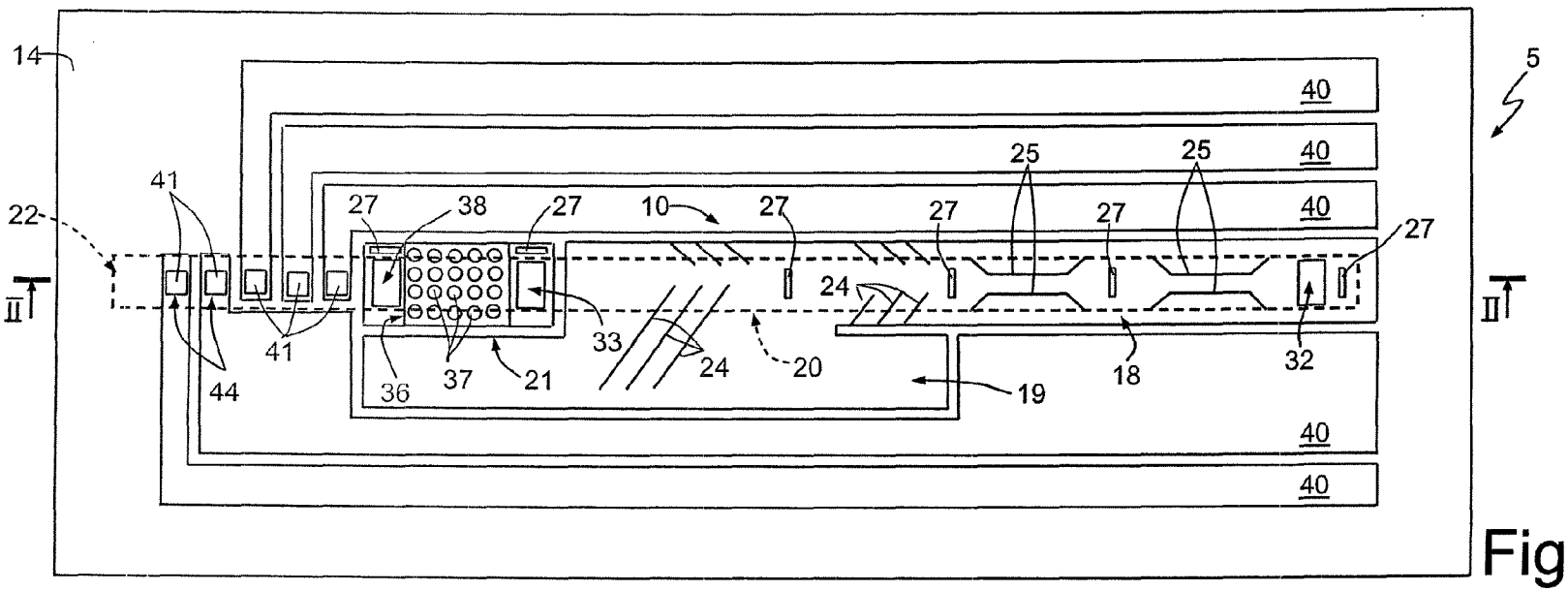
FIG. 2 is a top plan view of the microfluidic device of FIG. 1, parts whereof have been removed.
Figure 3:
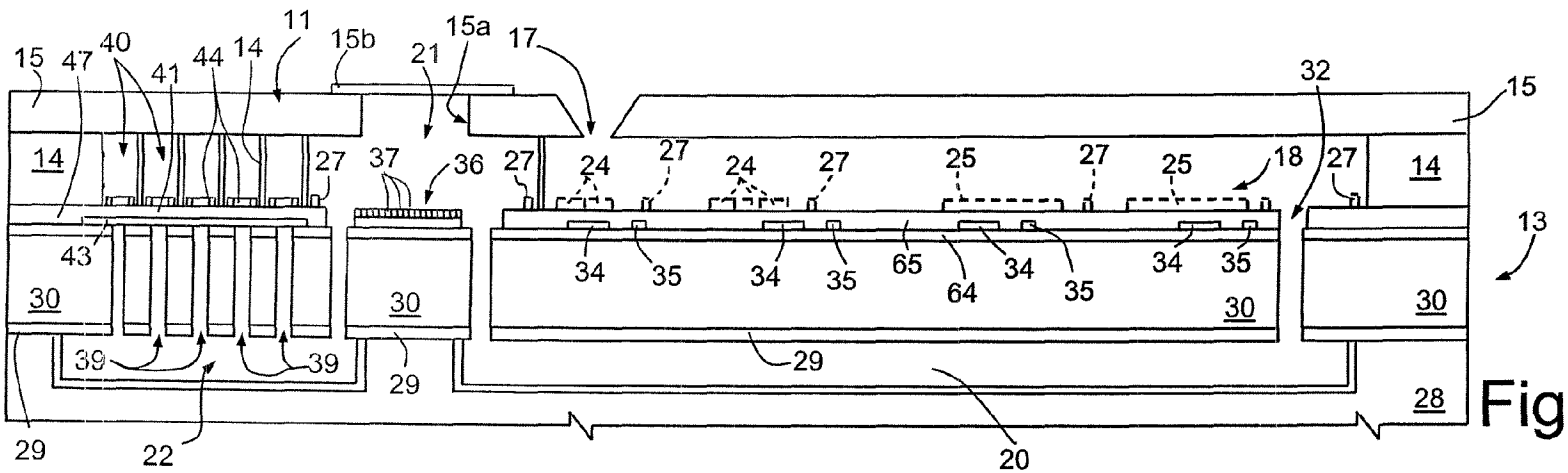
FIG. 3 is a cross-section through the microfluidic device of FIG. 1, taken according to line III-III of FIG. 2.

FIGS. 2 and 3 show the microreactor 5, which comprises a microfluidic circuit 10 and a micropump 11 for moving a biological sample through the microfluidic circuit 10. Furthermore, the microreactor 5 includes a monolithic semiconductor body 13 (i.e. obtained from a single wafer, without bonding or welding different wafers or bodies together), wherein part of the microfluidic circuit 10 is formed; and a structure including a structural layer 14 of resist and a transparent cap layer 15, and accommodating the micropump 11 and the remainder of the microfluidic circuit 10. The structural layer 14 is arranged on the semiconductor body 13 and the cap layer 15 (not shown in FIG. 2) is bonded on the structural layer 14.

The microfluidic circuit 10 comprises an inlet 17, a sample preparation channel 18, a waste reservoir 19, at least an amplification channel 20, a detection chamber 21 and a coupling channel 22. In the embodiment herein described, the sample preparation channel 18, the waste reservoir 19 and the detection chamber 21 are formed in the structural layer 14, whereas the amplification channel 20 and the coupling channel 22 are "buried" in the semiconductor body 13.

Preferably, a "buried" channel or chamber is herein a channel or chamber that is buried inside of a single monolithic support, as opposed to a channel or chamber that is made by welding or otherwise bonding two supports with a channel or two half channels together. Buried channels may be made in various ways, including as described in U.S. Pat. Nos. 6,770,471, 6,673,593, US-A-20040096964, US-A-20040227207, U.S. Pat. Nos. 6,710,311, 6,670,257, 6,376,291.

The sample preparation channel 18 is accessible from the outside via the inlet 17, which is formed in the cap layer 15, so that a biological sample may be introduced into the microfluidic circuit 10. The introduction of a biological sample into the inlet 17 seals the sample preparation channel 18.

Dielectrophoresis electrodes 24 and lysis electrodes 25 are arranged at respective sections of the sample preparation channel 18, with the lysis electrodes 25 placed downstream of the dielectrophoresis electrodes 24. The dielectrophoresis electrodes are so configured that activation thereof provides a non-uniform electric field, which applies forces on particles dispersed in the biological sample for separating nucleated and non-nucleated cells.

A plurality of fluid detectors 27, e.g. of capacitive or resistive type, are arranged along the sample preparation channel 18 for monitoring the advancement of the biological sample.

The amplification channel 20 is formed in a monocrystalline substrate 28 of the semiconductor body 13 and is overlaid by a growth layer 30, of polycrystalline silicon. More precisely, the amplification channel is upwardly delimited by a dielectric structure 29, which has a thickness of a few microns, and the growth layer 30 is formed thereon. Preferably, the amplification channel 20 is arranged under the sample preparation channel 18. At opposite ends of the amplification channel 20, apertures 32, 33 through the growth layer 30 provide fluid connection to the sample preparation channel 18 and to the detection chamber 21. Moreover, heaters 34, of polysilicon, are formed on the growth layer 30 above and across the amplification channel 20. Temperature sensors 35 are arranged on the growth layer 30 as well, in the vicinity of respective heaters 34. Owing to the high thermal conductivity and low thermal capacity of silicon, the heaters 34 and the temperature sensors 35 are thermally coupled to the interior of the amplification channel 20.

The dielectrophoresis electrodes 24, the lysis electrodes 25, the fluid detectors 27, the heaters 34 and the temperature sensors 35 are connected to the interface 9 (not shown in FIG. 2) over conductive lines (not shown), so that an electrical connection may be established with the processing unit 3 and the power source 4 when the board 7 is loaded in the driver device 8.

A microarray 36 of electrodes 37, preferably of gold, is arranged in the detection chamber 21, which is also equipped with further fluid presence detectors 27. The electrodes 37 are suitable for grafting nucleic acid probes (not shown) during a conventional functionalization process. The detection chamber 21 communicates with the coupling channel 22 via aperture 38, and the coupling channel 22 is in turn connected to the micropump 11 by suction passages 39 through the growth layer 30. The cap layer 15 has a window 15*a* above the detection chamber 21. Moreover, the window 15*a* is closed by a removable transparent plate 15*b* of a biocompatible material, to enable both functionalization of the microarray 36 and optical coupling of the microarray 36 with an external reader (not shown) of the driver device 8. The plate 15*b* provides an airtight seal when secured to the cap layer 15. An adhesive removable foil may be provided instead of the plate 15*b*.

Figure 4:
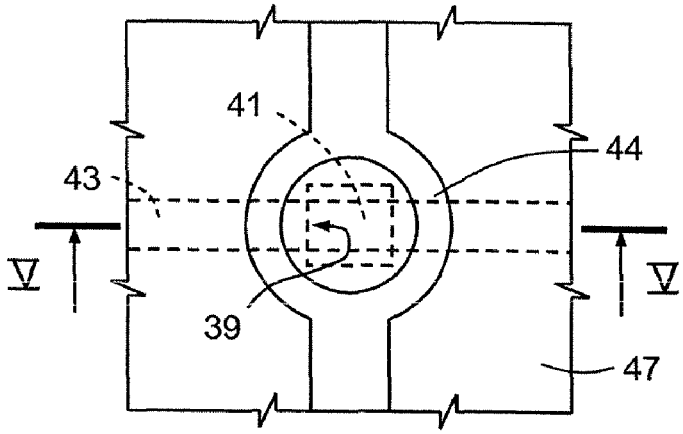
FIG. 4 is an enlarged view of a detail of FIG. 2, parts whereof have been removed.
Figure 5:
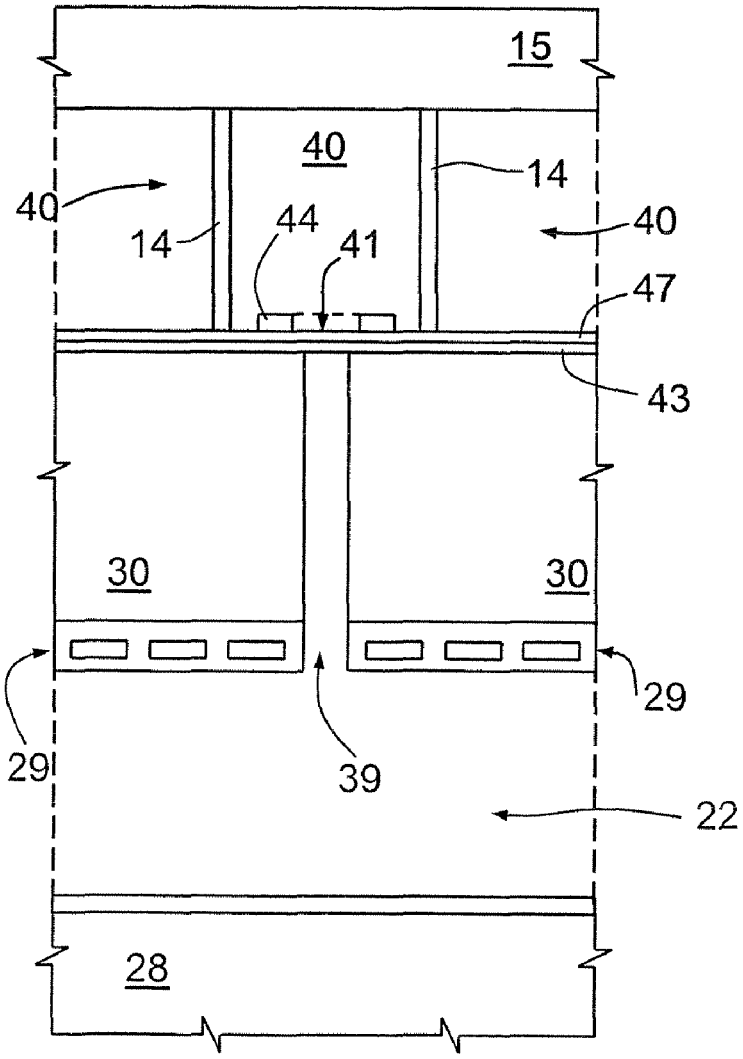
FIG. 5 is a cross-section of the detail of FIG. 4, taken according to line V-V of FIG. 4.

With reference also to FIGS. 4 and 5, the micropump 11 comprises a plurality of vacuum chambers 40, sealed by respective diaphragms 41, and first and second electrodes 43, 44 arranged on opposite sides of the diaphragms 41 for selective electrical opening thereof.

Hereinafter, the definition "vacuum chamber" will be used to designate fluid-proof chambers either formed or sealed under pre-determined low pressure conditions, so that a first air pressure therein is lower than environmental air pressure, namely than a second air pressure in the microfluidic circuit 10. It is also understood that the air pressure level in the vacuum chambers is preserved until the vacuum chambers are opened.

The vacuum chambers 40 include respective superficial channels formed in the structural layer 14 and sealed between the semiconductor body 13 and the cap layer 15. Hence, the vacuum chambers 40 are external to the semiconductor body 13 and are delimited by the semiconductor body 13 (downwardly), by the structural layer 14 (laterally) and the by cap layer 15 (upwardly). In the embodiment herein described, the vacuum chambers 40 extend around the detection chamber 21, on either sides of the sample preparation channel 18 and partly above the coupling channel 22. The vacuum chambers 40 therefore include channel portions that are arranged parallel to the sample preparation channel 18 and adjacent to one another.

Each vacuum chamber 40 is associated with a respective suction passage 39 of the microfluidic circuit 10. In an initial configuration of the micropump 11, however, fluidic connection between the vacuum chambers 40 and the corresponding suction passages 39 is prevented by the respective diaphragms 41 (see FIG. 5), so that the air pressure level inside the vacuum chambers 40 is preserved. The diaphragms 41 are selectively openable in successive configurations of the micropump 11, so that the corresponding vacuum chambers 40 are fluidly coupled to the respective suction passages 39 of the microfluidic circuit 10. Due to the low air pressure in the vacuum chambers 40, air and any fluids contained in the microfluidic circuit 10 are sucked toward the vacuum chambers 40 on opening the diaphragms 41.

The diaphragms 41 are integrated in the semiconductor body 13, at ends of respective suction passages 30 of the microfluidic circuit 10. More specifically, the diaphragms 41 include respective portions of a dielectric sealing layer 47 formed on the growth layer 30.

The micropump 11 also includes one common first electrode 43 and individual second electrodes 44 for each vacuum chamber 40. The common first electrode 43 is arranged between the growth layer 30 and the sealing layer 47 and is so configured as to only partially occlude the suction passages 39. Preferably, the common first electrode 43 is narrower than the suction passages 39. The second electrodes 44 are formed on the sealing layer 47 and run perpendicular to the common first electrode 43. Each second electrode 44 crosses the common first electrode 43 at the diaphragm 41 of the respective vacuum chamber 40. The common first electrode 43 and the second electrodes 44 are configured to allow air passage when the diaphragms 41 are opened. In the embodiment herein described, the second electrodes 44 include respective annular portions arranged around the respective diaphragms 41 (see FIG. 4).

The common first electrode 43 and the second electrodes 44 may be used to electrically break the diaphragms 41 to provide fluidic connection between the microfluidic circuit 10 and the vacuum chambers 40.

Figure 6:
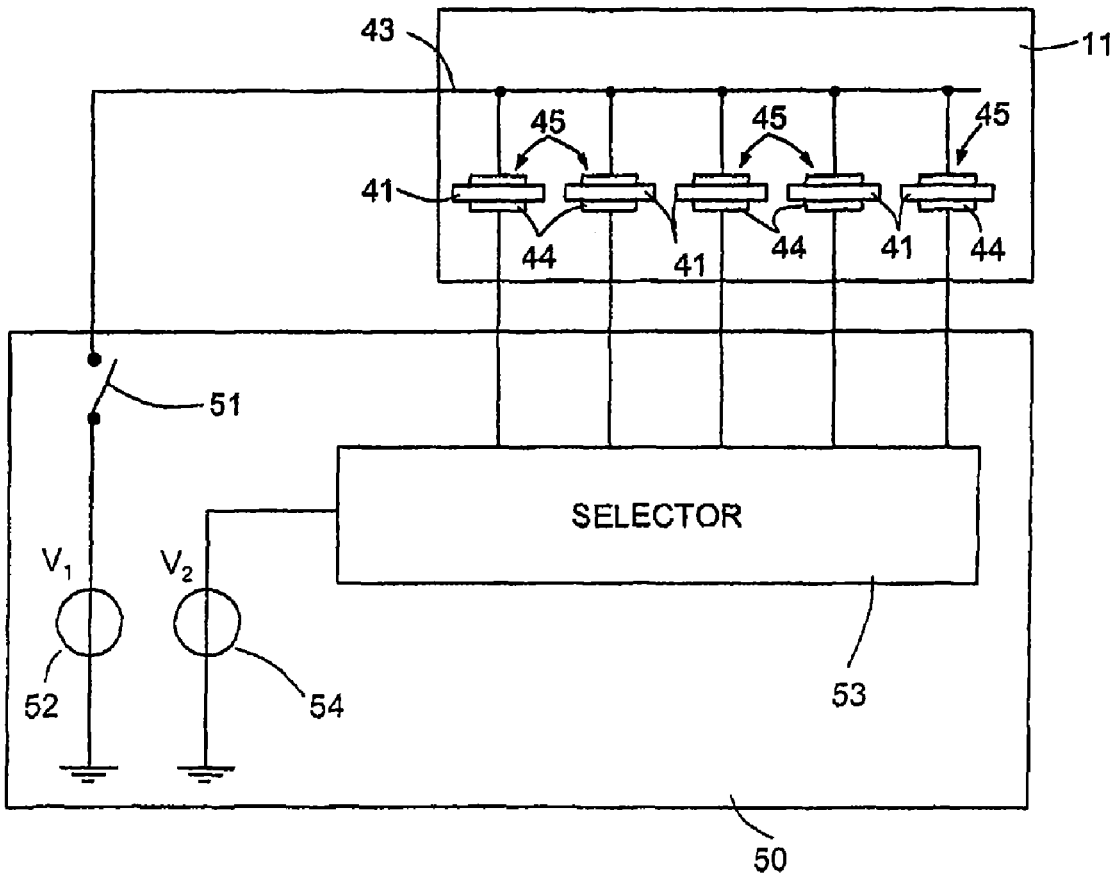
FIG. 6 is a simplified electrical diagram of a portion of the system of FIG. 1.
Figure 7:
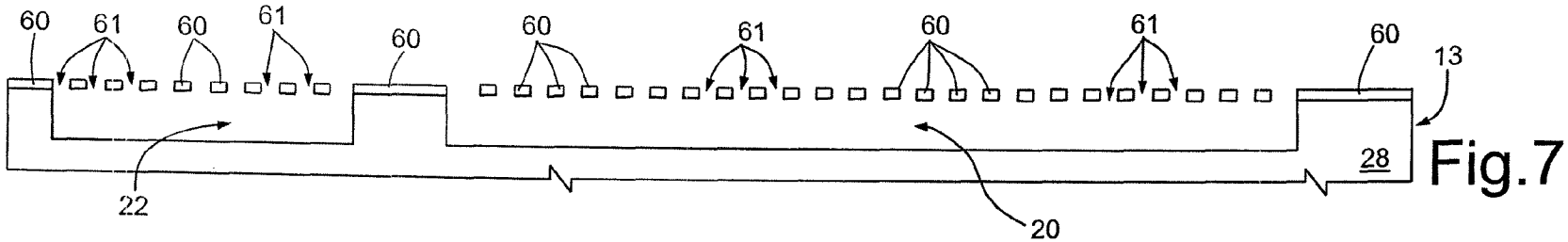
FIGS. 7-12 are cross sectional views through a body in subsequent steps of a process for manufacturing the microfluidic device of FIGS. 1-5.

FIG. 6 illustrates a simplified electrical diagram of the micropump 11 and of a control circuit 50 thereof, which is provided in the processing unit 3. In practice, the first and the second electrodes 43, 44 define first and second plates of capacitors 45 at their crossing points (i.e. at ends of the suction passages adjacent to the vacuum chambers 40) and respective diaphragms 41 are interposed therebetween. The common first electrode 43 is connectable, via a switch 51, to a first voltage source 52, supplying a first voltage V1. Through a selector 53, the second electrodes 44 are selectively connectable to a second voltage source 54, which supplies a second voltage V2, preferably, having opposite sign to the first voltage V1. Thus, the capacitors 45 may be sequentially selected and supplied with an activation voltage which is equal to V1−V2 and higher than a breakdown voltage of the sealing diaphragms 41. Therefore, the sealing diaphragms 41 may be selectively and sequentially broken and the vacuum chambers 40 will then be fluidly coupled to the respective suction passages 39 of the microfluidic circuit 10. The selector 53 is operated based on fluid feedback signals $S_P$ provided by the fluid detectors 27, so that the micropump 11 may be controllably activated to move the fluid through the microfluidic circuit 10 according to a predetermined motion profile.

A manufacturing process of the microreactor 5 will be hereinafter described, with reference to FIGS. 7-12. Initially, a hard mask 60 is formed on the substrate 28 of the semiconductor body 13 by depositing and subsequently defining a silicon nitride layer and a silicon carbide layer (for the sake of simplicity, the hard mask 60 is depicted as a single layer structure in FIG. 7). The hard mask 60 has a plurality of apertures 61 forming a grid above regions of the substrate 28 wherein the amplification channel 20 and the coupling channel 22 are to be formed. The substrate 28 is then etched using the hard mask 60 to create the amplification channel 20 and the coupling channel 22, which have triangular cross section in the embodiment herein described.

Figure 8:
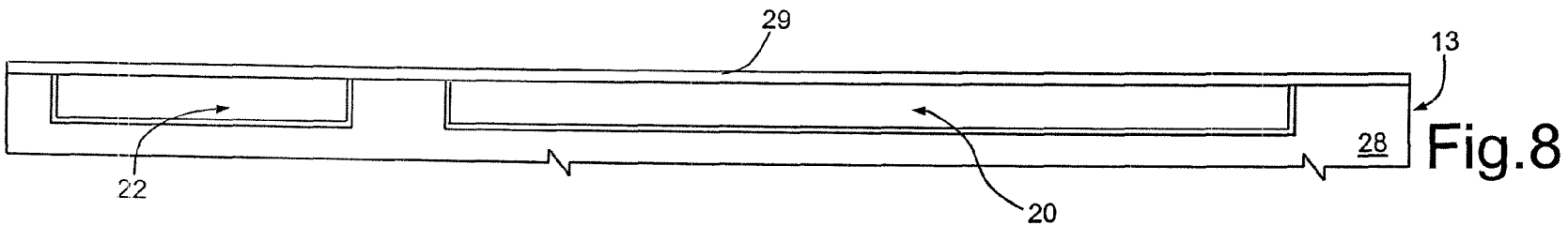
Figure 9:
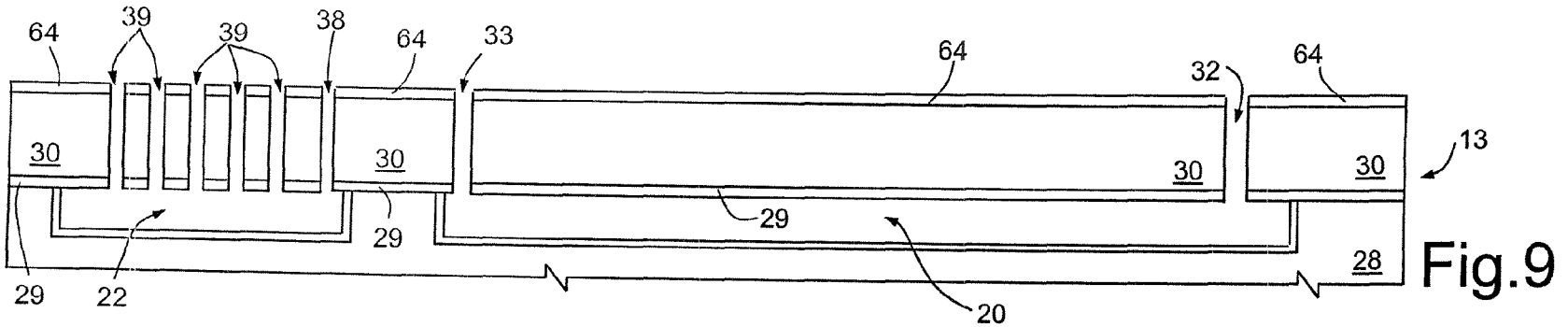

After depositing a thin layer of polysilicon (not shown) on the hard mask 60 and on the walls of the amplification channel 20 and of the coupling channel 22, the substrate 28 is thermally oxidized (FIG. 8). The apertures of the hard mask 60 are thus closed and the dielectric structure 29 is created (illustrated as a single layer in FIGS. 8-12).

Then (FIG. 9), the growth layer 30 is formed from a polysilicon seed layer (not shown) deposited on the dielectric structure 29 and a superficial oxide layer 64 is created by thermal oxidation. The superficial oxide layer 64, the growth layer 30 and the dielectric structure 29 are etched to open the apertures 32, 33, 38 and the suction passages 39.

Figures 10, 11, 12:
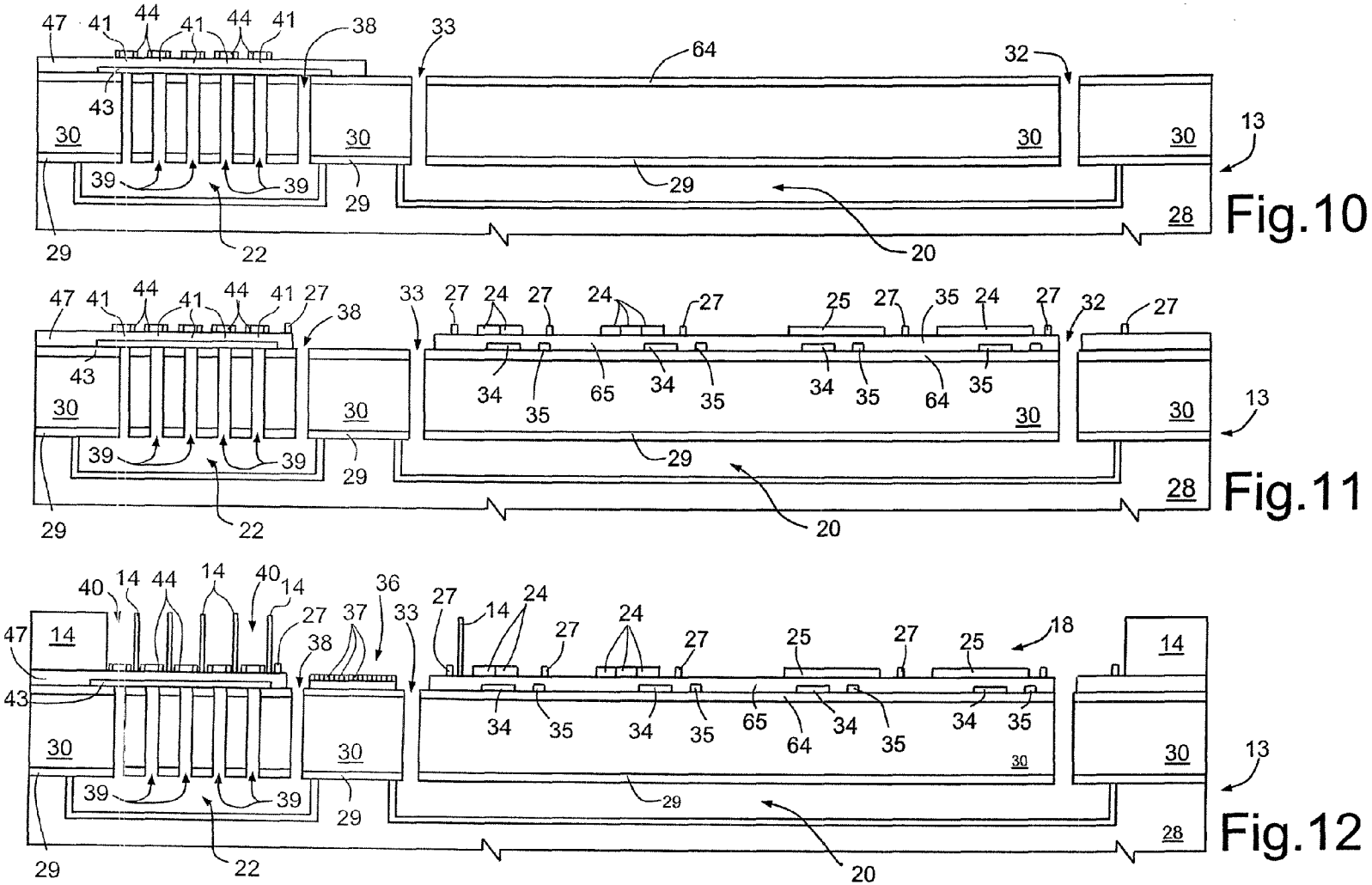
Figure 13:
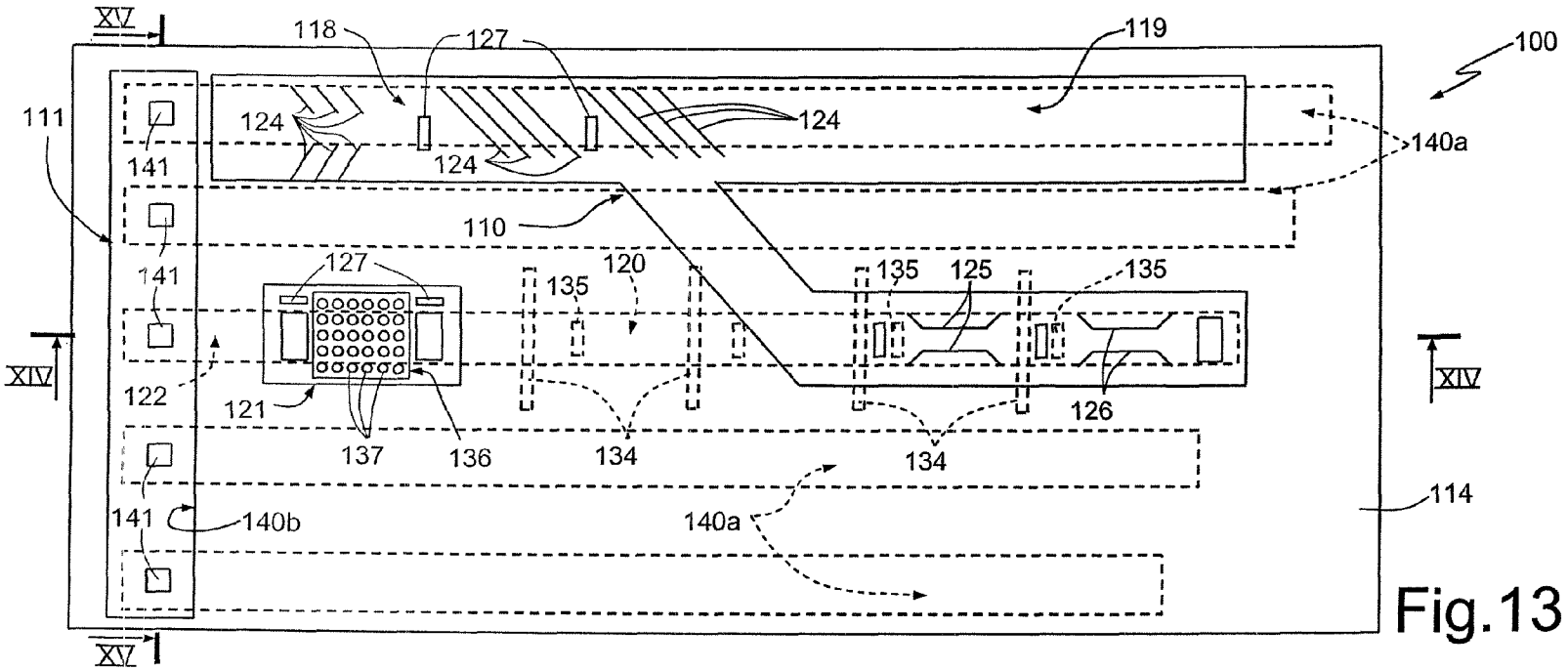
FIG. 13 is a top plan view, with parts removed, of a microfluidic device according to a second embodiment of the present invention.

With reference to FIG. 10, the common first electrode 43 is formed by delineating a first metal layer (not shown) deposited on the superficial oxide layer 64. After depositing and shaping the dielectric sealing layer 47 to form the diaphragms 41, a second metal layer (not shown) is deposited and delineated to create the second electrodes 44.

Then (FIG. 11), the heaters 34 and the temperature sensors 35 are formed above the amplification channel 20 and incorporated in an oxide base 65. In particular, the oxide base 65 covers the whole surface of the semiconductor body 13, except the diaphragms 41 and defines inlets of the vacuum chambers 40 (here not shown). A third metal layer (not shown), is deposited and selectively etched to form the dielectrophoresis electrodes 24, the lysis electrodes 25 and electrodes for the microarray 36.

Then (FIG. 12), the structural layer 14 is deposited on the semiconductor body 13 and delineated to laterally define the sample preparation channel 18, the detection chamber 21 and the vacuum chambers 40. Finally, the cap layer 15, wherein the window 15*a* ad the inlet 17 have been previously opened, is aligned and bonded to the structural layer 14 under predetermined low pressure conditions, as required in the vacuum chambers 40. The microfluidic circuit 10 and the micropump 11 are thus completed and the structure of FIG. 3 is obtained.

According to a second embodiment of the invention, shown in FIGS. 13-16, a microreactor 100 comprises a microfluidic circuit 110 and a micropump 111. Both the microreactor 100 and the micropump 111 are partly accommodated in the same monolithic semiconductor body 113 and partly defined by a structural layer 114 of resist and by a cap layer 115 (not shown in FIG. 13). The structural layer 114 is arranged on the semiconductor body 113 and the cap layer 115 is bonded to the structural layer 114.

The microfluidic circuit 110 comprises an inlet (not shown), a sample preparation channel 118, a waste reservoir 119, at least one amplification channel 120, a detection chamber 121 and a coupling channel 122. The sample preparation channel 118, the waste reservoir 119 and the detection chamber 121 are formed in the structural layer 114, whereas the amplification channel 120 and the coupling channel 122 are buried in the semiconductor body 113.

The sample preparation channel 118 is accessible from the outside via the inlet, which is formed in the cap layer 115, so that a biological sample may be introduced into the microfluidic circuit 110.

Dielectrophoresis electrodes 124 and lysis electrodes 125 are arranged in the sample preparation channel 118 at respective sections thereof. The dielectrophoresis electrodes 124 are configured to separate nucleated and non-nucleated cells by applying a transverse electric field, when a biological sample is provided in the sample preparation channel 118, and to drive the non-nucleated cells toward the waste reservoir 119, whereas the nucleated cells are deviated toward the lysis electrodes 125. A plurality of fluid detectors 127 are arranged along the sample preparation channel 118 for monitoring the advancement of the biological sample.

The amplification channel 120 is formed in a monocrystalline substrate 128 of the semiconductor body 113 and is overlaid by a dielectric structure 129 and by a growth layer 130, of polycrystalline silicon. Opposite ends of the amplification channel 120 are fluidly coupled to the sample preparation channel 118 and to the detection chamber 121 through apertures 132, 133, respectively. Heaters 134 of polysilicon are formed on the growth layer 130 above and across the amplification channel 120. Temperature sensors 135 are arranged on the growth layer 130 as well, in the vicinity of respective heaters 134.

A microarray 136 of electrodes 137 is arranged in the detection chamber 121, along with further fluid detectors 127. The electrodes 137 are suitable for grafting nucleic acid probes (not shown) during a conventional functionalization process. The detection chamber 121 communicates with the coupling channel 122 via aperture 138, and the coupling channel 122 is in turn connected to the micropump 111 by a suction passage 139 through the growth layer 130. Above the detection chamber 121, the cap layer 115 has a window 115*a*, which is closed by a biocompatible removable cover 115*b*, such as a transparent plate or an adhesive foil. The cover 115*b* provides an airtight seal when secured to the cap layer 115.

Figure 16:
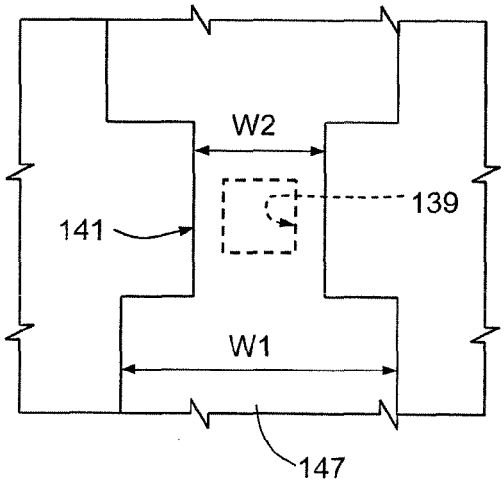
FIG. 16 is an enlarged view of a detail of FIG. 13, parts whereof have been removed.
Figure 17:
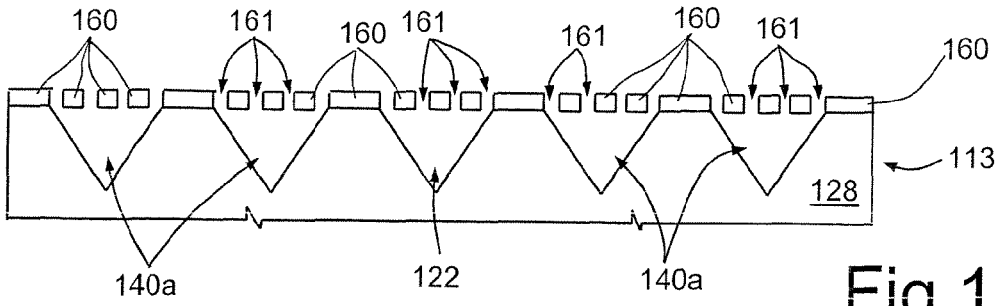
FIGS. 17-20 are cross sectional views through a body in subsequent steps of a process for manufacturing the microfluidic device of FIGS. 13-16.

The micropump 111 comprises a plurality of buried vacuum chambers 140*a*, a superficial vacuum chamber 140*b* and electrodes 147, respective portions whereof form diaphragms 141 for sealing the buried vacuum chambers 140*a* and the superficial vacuum chamber 140*b* (the electrodes 147 are shown in detail only FIG. 16, for simplicity). A first air pressure within the buried vacuum chambers 140*a* and the superficial vacuum chamber 140*b* is lower than an environmental air pressure, namely than a second air pressure in the microfluidic circuit 10.

The buried vacuum chambers 140*a* include respective microchannels, formed in the semiconductor body 113 and arranged adjacent and parallel to the amplification channel 120 and to the coupling channel 122. The superficial vacuum chamber 140*b* is delimited by the structural layer 114 laterally, and by the cap layer 115 upwardly. Hence, the superficial vacuum chamber 140*b* is external to the semiconductor body 113. Moreover, the superficial vacuum chamber 140*b* is arranged transversely to the buried vacuum chambers 140*a* and to the coupling channel 121, above ends thereof. Connecting passages 142 between the buried vacuum chambers 140*a* and the superficial vacuum chamber 140*b*, as well as the suction passage 139, are sealed by the diaphragms 141 in this configuration of the micropump 111.

With reference to FIG. 16, the electrodes 147 are in the form of metal strips, deposited on the growth layer 130 of the semiconductor body 113 and having a first width W1. The diaphragms 141 are defined by narrow, high-resistance portions of the electrodes 147, having a second width W2 smaller than the first width W1. The diaphragms 141 are however wide enough to completely seal ends of the suction passage 139 and of the connection passages 142 adjacent to the superficial vacuum chamber 140*b*.

The diaphragms 141 are selectively openable in subsequent configurations of the micropump 111 to fluidly couple the microfluidic circuit 110 first to the superficial vacuum chamber 140*b* and then, in succession, to the buried vacuum chambers 140*a*.

The diaphragms 141 may be broken by providing overcurrents to the corresponding electrodes 147. Energy dissipation is higher in the diaphragms 141 than elsewhere in the electrodes 147, because of smaller cross section thereof. Thus, the diaphragms 141 blow out first and the respective vacuum chambers 140*a*, 140*b* are opened.

A process for manufacturing the microreactor 100 will be hereinafter described, with reference to FIGS. 17-20.

Initially, a hard mask 160 is formed on the substrate 128 of the semiconductor body 113. The hard mask 160 has a plurality of apertures 161 forming grids above regions of the substrate 128 wherein the amplification channel 120, the coupling channel 122 and the buried vacuum chambers 140*a* are to be formed. The substrate 128 is then etched using the hard mask 160, thereby creating the amplification channel 120 (here not shown), the coupling channel 122 and the buried vacuum chambers 140*a* simultaneously. All the buried channels and chambers have triangular cross section in the embodiment herein described, but other configurations may be employed as well.

Figure 18:
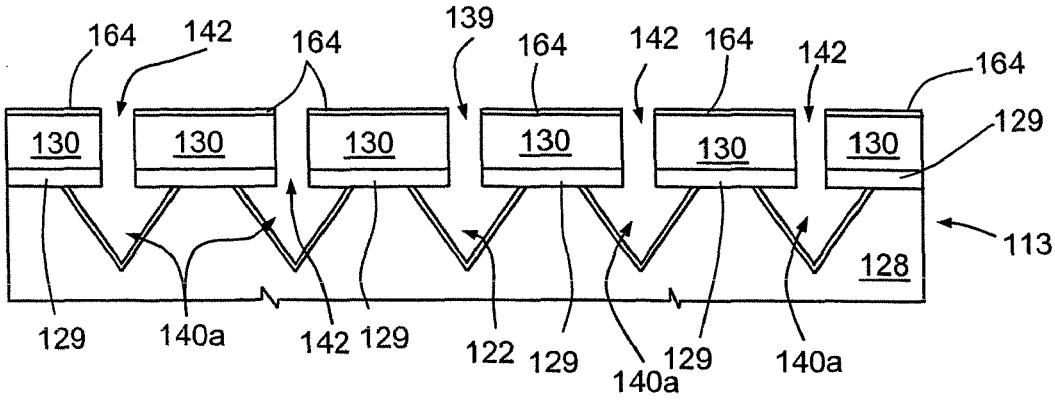

Apertures 161 are closed by deposition of thin polysilicon layer and thermal oxidation and the dielectric structure 129 is thus formed (FIG. 18). Then, the growth layer 130 is formed from a polysilicon seed layer (not shown) deposited on the dielectric structure 129 and a superficial oxide layer 164 is created by thermal oxidation. The superficial oxide layer 164, the growth layer 130 and the dielectric structure 129 are etched to form the apertures 132, 133, 138 (here not shown), the suction passage 139 and the connecting passages 142.

Figure 19:
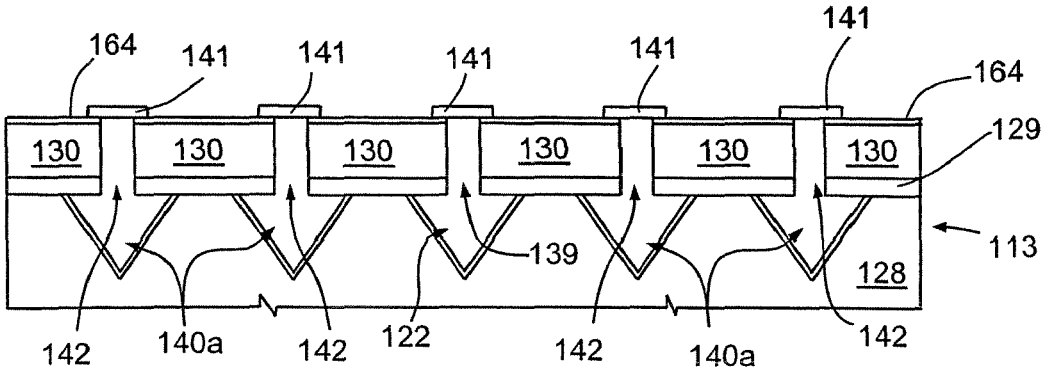
Figure 20:
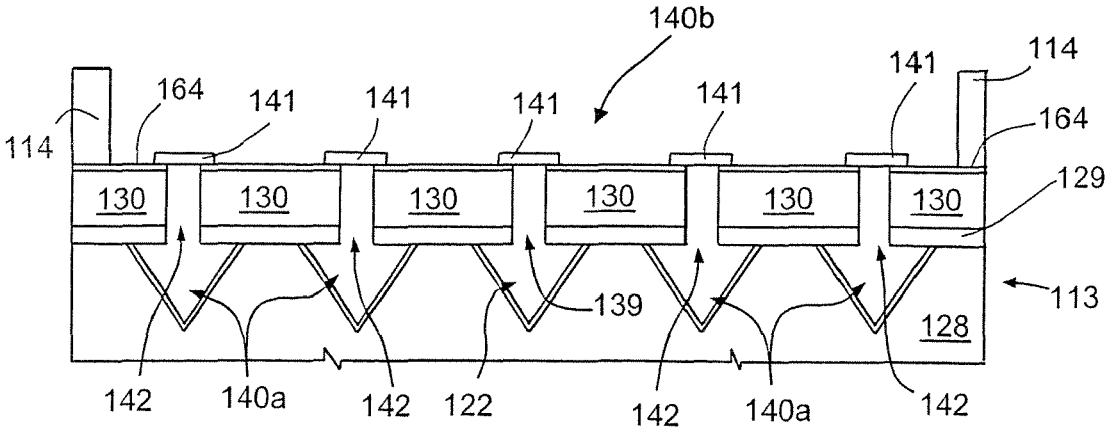

A metal layer (not shown) is deposited on the semiconductor body 113 under low pressure conditions, as required in the buried vacuum chambers 140*a*, and subsequently delineated to form the electrodes 147 with the respective diaphragms 141 (FIG. 19). The buried vacuum chambers 140*a* are thus sealed and the suction passage 139 is tightly closed.

The heaters 134, the temperature sensors 135, the dielectrophoresis electrodes 124 and the lysis electrodes 125 (here not shown) are formed as already described with reference to FIG. 11.

Figure 14:
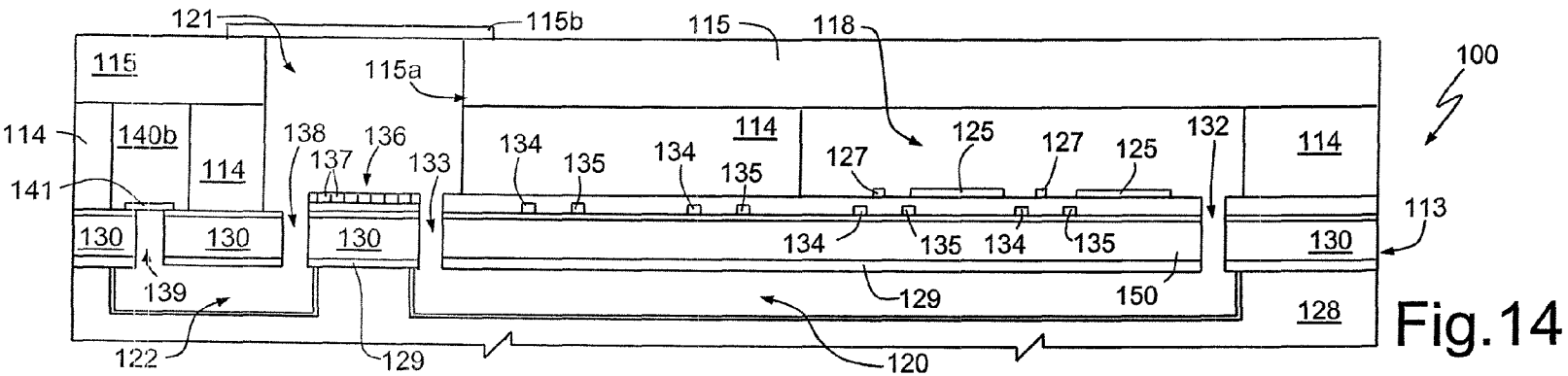
FIG. 14 is a cross-section through the microfluidic device of FIG. 13, taken according to line XIV-XIV of FIG. 13.
Figure 15:
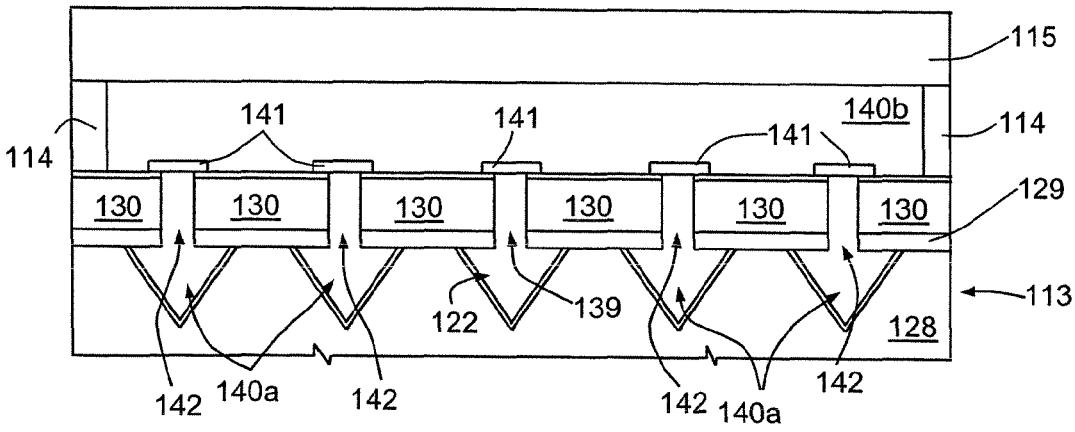
FIG. 15 is a cross-section through the microfluidic device of FIG. 13, taken according to line XV-XV of FIG. 13.

Then (FIG. 20), the structural layer 114 is deposited on the semiconductor body 113 and delineated to laterally define the sample preparation channel 118, the detection chamber 121 and the superficial vacuum chamber 140*b*. Finally, the cap layer 115, wherein the window 115*a* and the inlet have been previously opened, is aligned and bonded to the structural layer 114 under predetermined low pressure conditions, as required in the superficial vacuum chamber 140*b*. The microfluidic circuit 110 and the micropump 111 are thus completed and the structure of FIGS. 14 and 15 is obtained.

Figure 21:
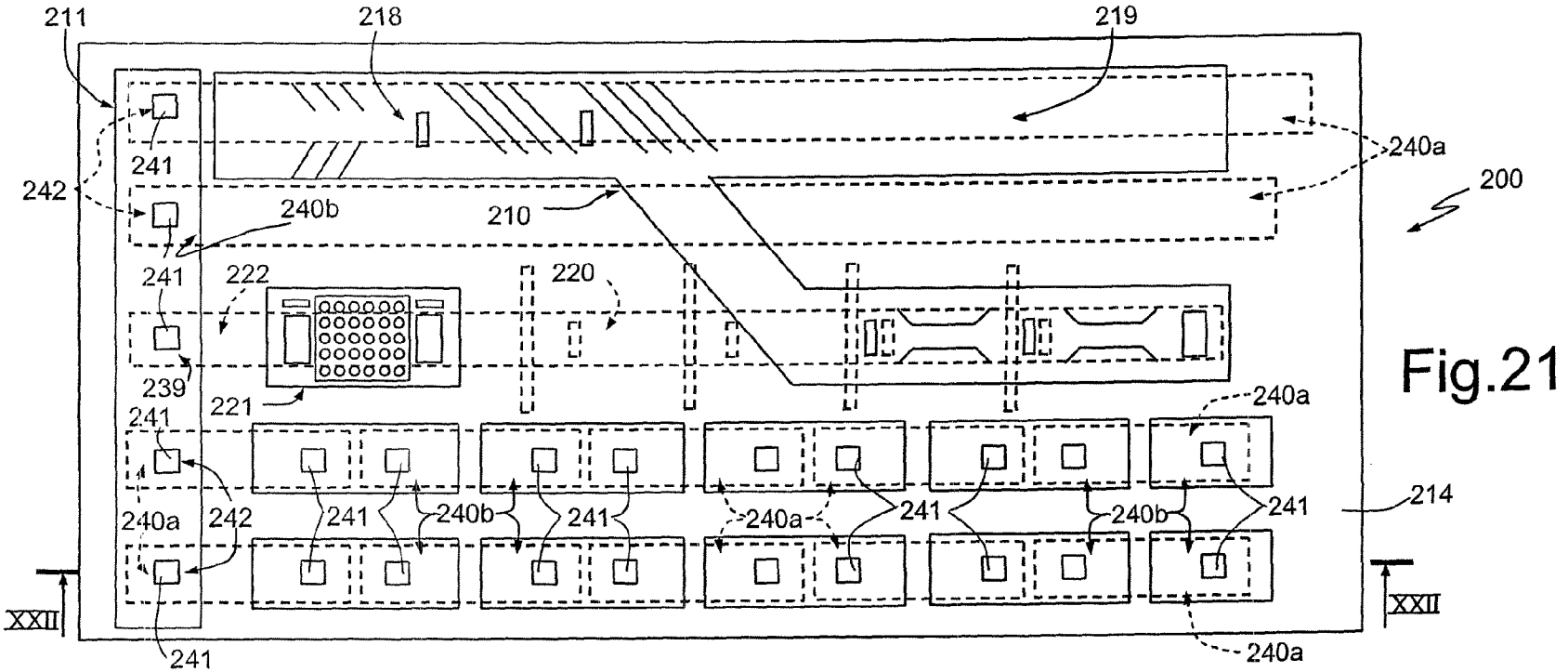
FIG. 21 is a top plan view, with parts removed, of a microfluidic device according to a third embodiment of the present invention.
Figure 22:
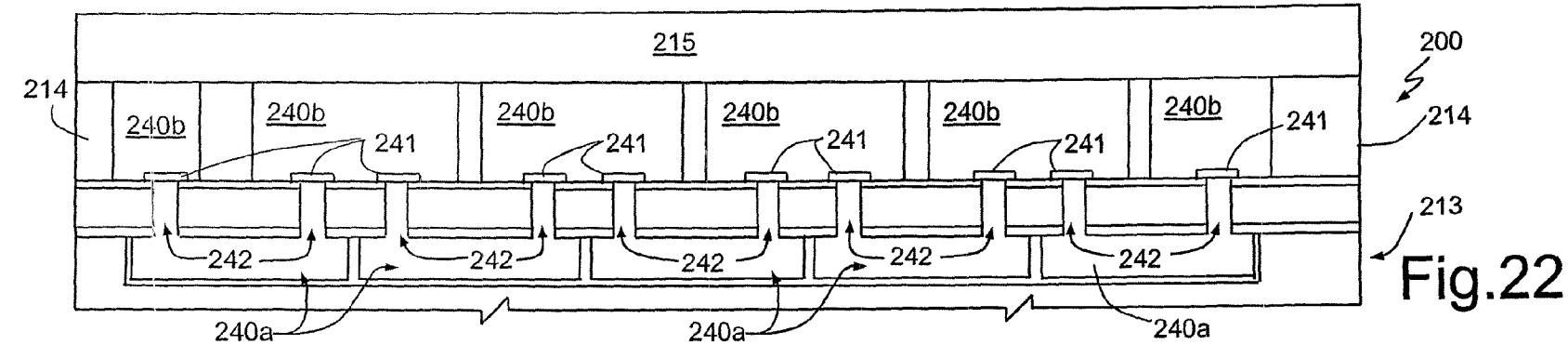
FIG. 22 is a cross-section through the microfluidic device of FIG. 21, taken according to line XXII-XXII of FIG. 21.

A third embodiment of the invention is illustrated in FIGS. 21 and 22. In this case, a microreactor 200 includes a microfluidic circuit 210 and a micropump 211, which are partly formed in a monolithic semiconductor body 213 and partly defined by a resist structural layer 214, deposited on the semiconductor body 213, and by a cap layer 215 bonded to the structural layer 214. The microfluidic circuit 210 includes a sample preparation channel 218, an amplification channel 220, a detection chamber 221 and a suction channel 222 for connection with the micropump 211. The amplification channel 220 and the suction channel 222 are buried in the semiconductor body 213.

The micropump 211 includes a plurality of buried vacuum chambers 240*a*, formed in the semiconductor body 213, and a plurality of superficial vacuum chambers 240*b*, defined in the structural layer 214 and sealed by the cap layer 215. Hence, the buried vacuum chambers 240*a* and the superficial vacuum chambers 240*b* are internal and external to the semiconductor body 213, respectively. The buried vacuum chambers 240*a* include respective microchannels, formed in the semiconductor body 213 and arranged adjacent and parallel to the amplification channel 220. The superficial vacuum chambers 240*b* therefore include channel portions that are arranged parallel to the sample preparation channel 18. Groups of alternated buried vacuum chambers 240*a* and superficial vacuum chambers 240*b* are connectable in series through connecting passages 242. One superficial vacuum chamber 240*b* in each group is connectable to the microfluidic circuit 210 via a respective suction passage 239. The suction passages 239 and the connecting passages 242 are sealed by respective electrically openable diaphragms 241, here formed by portions of electrodes 247.

Sequentially opening the diaphragms 241 provides fluidic connection between the vacuum chambers 240*a*, 240*b* and the microfluidic circuit 210 and implements a micro stepping fluid moving.

Figure 23:
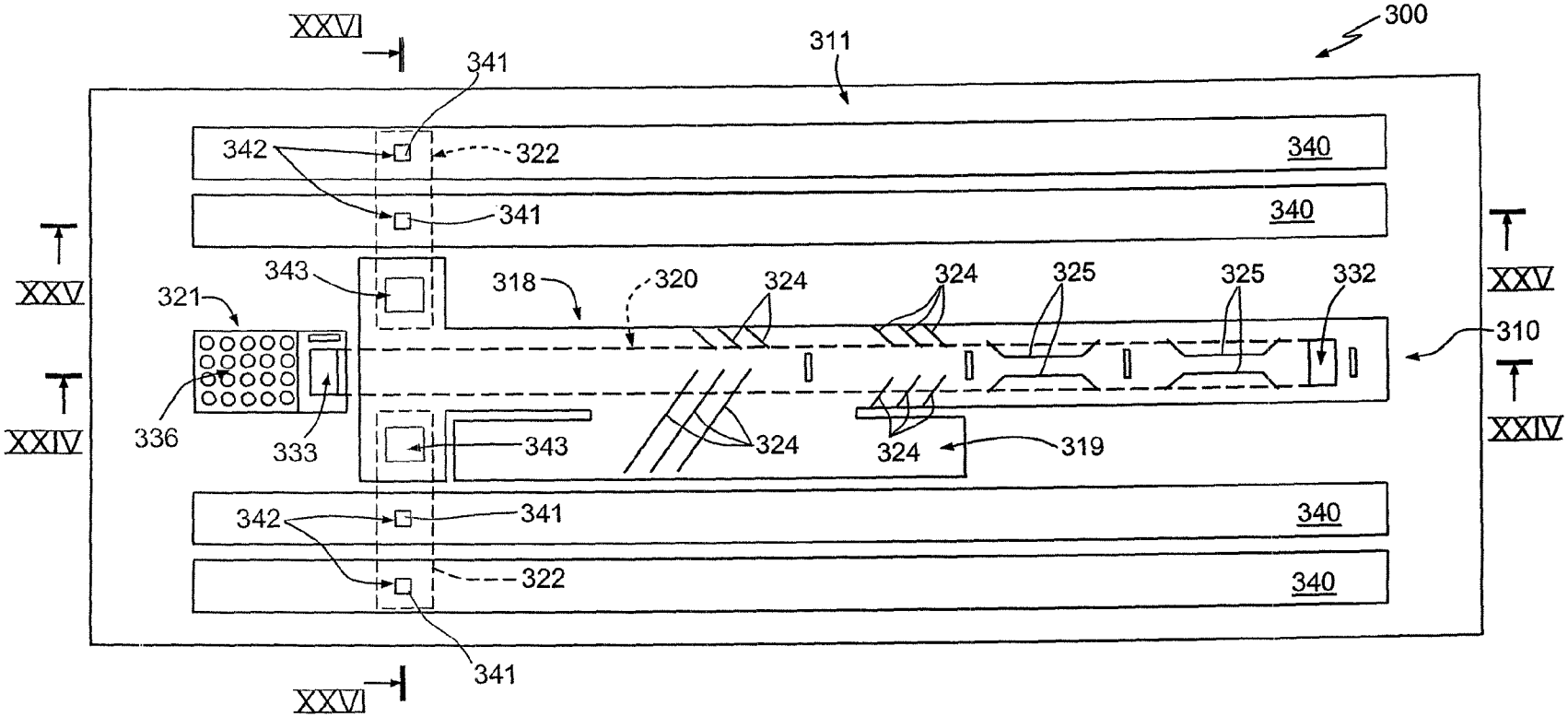
FIG. 23 is a top plan view, with parts removed, of a microfluidic device according to a fourth embodiment of the present invention.
Figure 24:
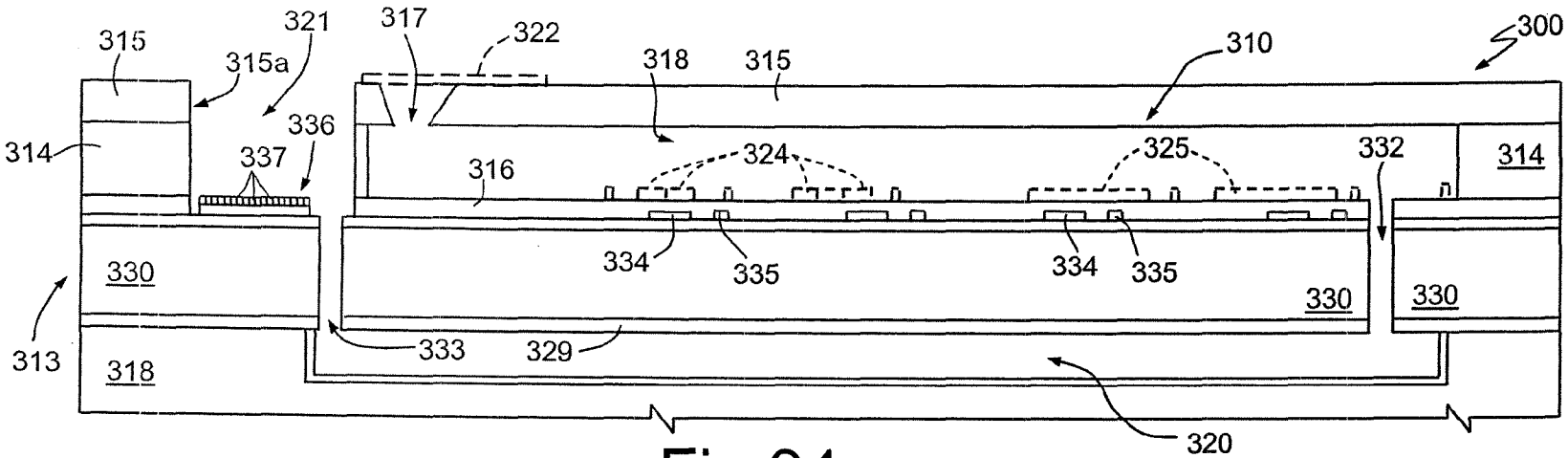
FIG. 24 is a cross-section through the microfluidic device of FIG. 13, taken according to line XXIV-XXIV of FIG. 23.
Figure 25:
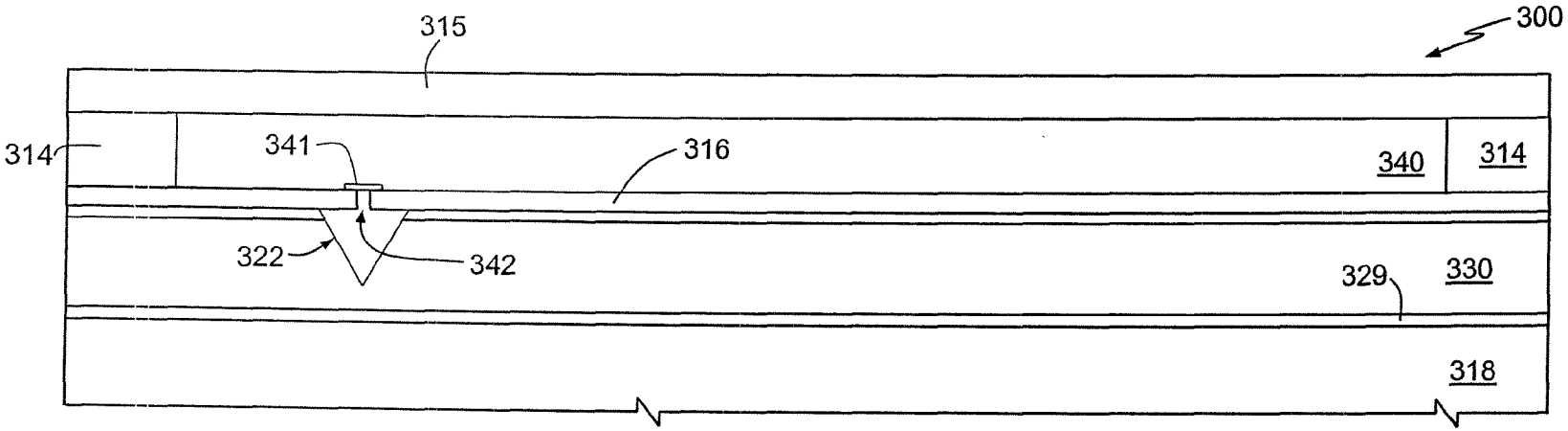
FIG. 25 is a cross-section through the microfluidic device of FIG. 13, taken according to line XXV-XXV of FIG. 23.

FIGS. 23-25 show a fourth embodiment of the invention. A microreactor 300 comprises a microfluidic circuit 310 and a micropump 311. The microfluidic circuit 310 is partly accommodated in a monolithic semiconductor body 313 and partly defined by a structural layer 314 of resist and by a cap layer 315 (not shown in FIG. 23). The structural layer 314 is arranged on a dry resist layer 316 that covers the semiconductor body 313 and the cap layer 315 is bonded to the structural layer 314.

The microfluidic circuit 310 comprises an inlet 317 (see FIGS. 24 and 25), a sample preparation channel 318, a waste reservoir 319, at least one amplification channel 320 and a detection chamber 321. Coupling channels 322 connect the microfluidic circuit 310 and the micropump 311. The sample preparation channel 318, the waste reservoir 319 and the detection chamber 321 are formed in the structural layer 314, whereas the amplification channel 320 is buried in the semiconductor body 313.

The sample preparation channel 318 is accessible from the outside via the inlet 317, which is formed in the cap layer 315, so that a biological sample may be introduced into the microfluidic circuit 310. A cover 323, e.g. a stick foil, is provided for sealing the inlet 317 after supplying a biological sample into the sample preparation channel 318.

Dielectrophoresis electrodes 324 and lysis electrodes 325 are arranged in the sample preparation channel 318 at respective sections thereof. The dielectrophoresis electrodes 324 are configured to separate nucleated and non-nucleated cells by applying a transverse electric field, when a biological sample is provided in the sample preparation channel 318, and to drive the non-nucleated cells toward the waste reservoir 319, whereas the nucleated cells are deviated toward the lysis electrodes 325. A plurality of fluid detectors 327 are arranged along the sample preparation channel 318 for monitoring the advancement of the biological sample.

The amplification channel 320 is formed in a monocrystalline substrate 328 of the semiconductor body 313 and is overlaid by a dielectric structure 329 and by a growth layer 330, of polycrystalline silicon. Opposite ends of the amplification channel 320 are fluidly coupled to the sample preparation channel 318 and to the detection chamber 321 through apertures 332, 333, respectively. Heaters 334 of polysilicon are formed on the growth layer 330 above and across the amplification channel 320. Temperature sensors 335 are arranged on the growth layer 330 as well, in the vicinity of respective heaters 334. The heaters 334 and the temperature sensors 335 are embedded in the dry resist layer 316.

A microarray 336 of electrodes 337 is arranged in the detection chamber 321, along with further fluid detectors 327. The electrodes 337 are suitable for grafting nucleic acid probes (not shown) during a conventional functionalization process. Above the detection chamber 321, the cap layer 315 has a window 315*a*, which is open.

The micropump 311 comprises a plurality of pressurized chambers 340, formed in the structural layer 314. Hereinafter, the definition "pressurized chamber" will be used to designate fluid-proof chambers either formed or sealed under predetermined high pressure conditions, so that air pressure therein is higher than environmental air pressure, namely than air pressure in the microfluidic circuit 310. It is also understood that the air pressure level in the pressurized chambers is preserved until the pressurized chambers are opened.

The pressurized chambers 340 include respective superficial channels formed in the structural layer 314 and sealed between the dry resist layer 316 and the cap layer 315. Hence, the vacuum chambers 40 are delimited by the dry resist layer 316 (downwardly), by the structural layer 314 (laterally) and the by cap layer 315 (upwardly). In the embodiment herein described, the pressurized chambers 340 extend on either sides of the sample preparation channel 318, parallel thereto and adjacent to one another.

Figure 26:
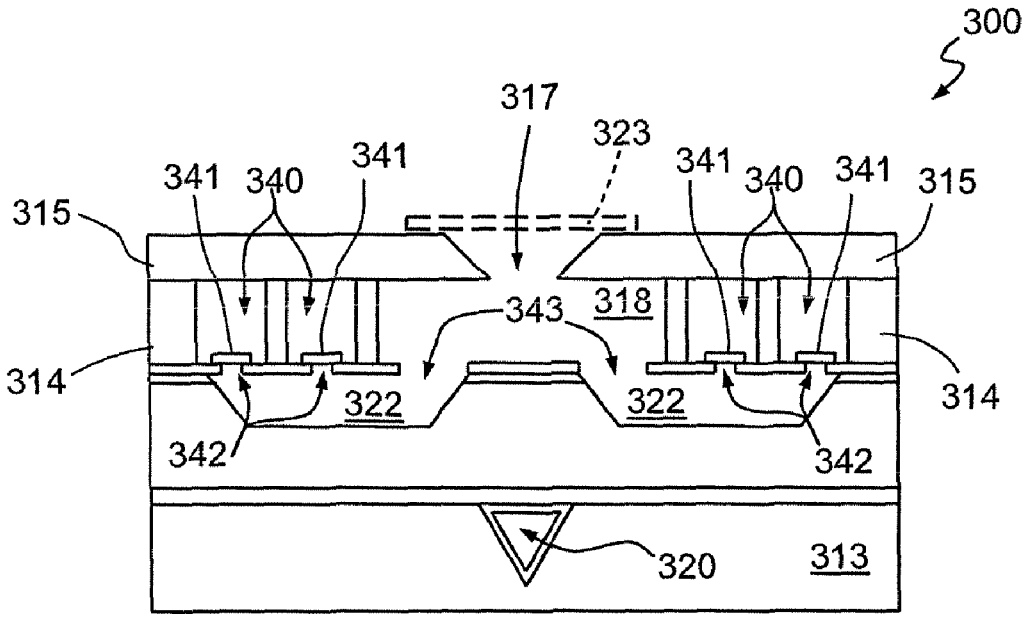
FIG. 26 is a cross-section through the microfluidic device of FIG. 13, taken according to line XXVI-XXVI of FIG. 23.
Figure 27:
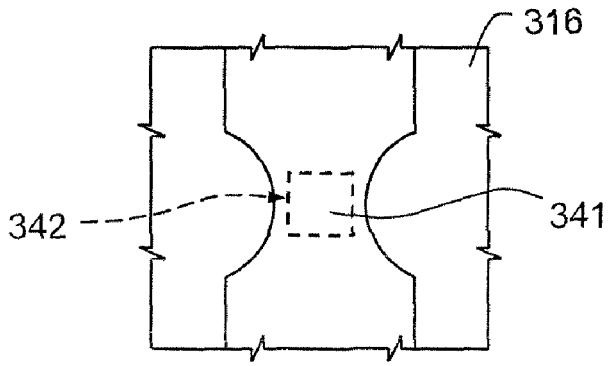
FIG. 27 is an enlarged view of a detail of FIG. 23, parts whereof have been removed.

Passages 342 are provided in the dry resist layer 316 for fluidly coupling each pressurized chamber 316 and the sample preparation channel 318 via the coupling channels 322. More precisely, the coupling channels 316 are accommodated in the semiconductor body 313, at the surface thereof, and are upwardly delimited by the dry resist layer 316. Moreover, the coupling channels 316 are arranged on opposite sides of the sample preparation channel 318 and run under and transversely to respective groups of pressurized chambers 340. Passages 342 are formed at intersections of the pressurized chambers and the respective coupling channel 322 and are reversibly closed by conductive diaphragms 341. Hence, pressurized chambers 340 are sealed until the conductive diaphragms 341 are electrically opened by current injection. As shown in FIG. 26, the diaphragms 341 include metal strips narrowing at the passages 342.

The coupling channels 322 are fluidly coupled to the sample preparation channel 318 through windows 343 provided in the dry resist layer 316. The inlet 317 is arranged downstream of the windows 343, so that, when a biological sample is supplied into the microfluidic circuit and the inlet 317 is sealed by the cover 323, opening the pressurized chambers 340 causes the biological sample to be pushed through the microfluidic circuit 310 away from the inlet 317, toward the detection chamber 321.

During manufacturing process of the microreactor 300, the amplification channel 320 is formed in the semiconductor body 313 and the heaters 334 and the temperature sensors 335 are provided thereon, as previously described. The dry resist layer 316 is deposited on the semiconductor body 313 and photolithographically defined for forming the passages 342 and the windows 343, and for clearing the apertures 332, 333. Then, a metal layer is deposited and delineated for forming the dielectrophoresis electrodes 324, the and lysis electrodes 325, the diaphragms 341 and electrical connections (not shown). The structural layer 314, of resist, is deposited on the semiconductor body 313 and delineated to laterally define the sample preparation channel 318, the detection chamber 321 and the vacuum chambers 340. Finally, the cap layer 315, wherein the window 315*a* and the inlet 317 have been previously opened, is aligned and bonded to the structural layer 314 under predetermined high pressure conditions, as required in the pressurized chambers 340.

The advantages of the invention are clear from the above description. First of all, the microfluidic device has a compact structure and only a small footprint is required. The embodiments described also show the great design flexibility introduced by the invention. Moreover, the micropump may be manufactured starting from the body wherein the microfluidic circuit, or at least part thereof, is integrated. Hence, processing a separate semiconductor body is not required. In addition, the microfluidic circuit and the micropump may be manufactured together and several processing steps may be shared. Moreover, there is no need to bond the finished micropump to the body including the microfluidic circuit. Thus, all of the problems involved in bonding are overcome, such as misalignments of the vacuum chambers with the suction passages of the microfluidic circuit. Therefore, fabrication of the microfluidic device according to the invention is substantially simplified and is cheaper.

Finally, it is clear that modifications may be made to the microfluidic device herein described, without departing from the scope of the present invention as defined in the appended claims. First, the invention may be advantageously exploited for any kind of devices that require controlled movement of a fluid through a microfluidic circuit. In the field of biochemical microreactors, devices for analysis of different substances may be produced.

As to microreactors for DNA analysis, like those previously described, a plurality of buried amplification channels may be integrated in the same semiconductor body. The amplification channels are preferably parallel to one another and may communicate either with separate detection chambers or with a same common detection chamber. Further, the channels may have individual or a common inlet ports or reagent chambers. Various microreactor configurations are described in US-A-20040132059, US-A-20040141856, U.S. Pat. Nos. 6,673,593, 6,710,311; 6,727,479; 6,770,471; 6,376,291, and 6,670,257.

The microreactor may comprise exclusively vacuum chambers formed in the semiconductor body, without any superficial vacuum chambers in the structural layer.

The number, the volume and the internal air pressure of the vacuum chambers, of course, depend on the configuration of the microfluidic circuit and on the desired motion profile of the fluids through the microfluidic circuit.

What is claimed is:

1. A microfluidic device for nucleic acid analysis comprising:

a) a monolithic semiconductor body and a structure arranged on said monolithic semiconductor body;

b) a micro fluidic circuit at least partially accommodated in said monolithic semiconductor body, wherein said microfluidic circuit includes a sample preparation channel formed on said monolithic semiconductor body and at least one microfluidic channel buried in said monolithic semiconductor body;

c) a micropump, including a plurality of sealed chambers provided with respective openable sealing elements and having a first pressure therein that is different from a second pressure in said microfluidic circuit, wherein said sealed chambers include at least one superficial sealed chamber formed in and delimited by said structure, above said monolithic semiconductor body, and said sealed chambers include at least one buried chamber formed inside said body;

wherein said micropump and said microfluidic circuit are configured so that opening said openable sealing elements provides fluidic coupling between the respective chambers and said microfluidic circuit, wherein said openable sealing elements are integrated in said monolithic semiconductor body; and wherein groups of alternating buried chambers and superficial sealed chambers are series connectable through connecting passages reversibly closed by respective openable sealing elements and wherein one superficial sealed chamber in each group is connectable to said microfluidic circuit.

2. A micro fluidic device according to claim 1, wherein said sealed chambers include a plurality of superficial sealed chambers formed in and delimited by said structure, above said monolithic semiconductor body.

3. A microfluidic device according to claim 2, wherein said superficial sealed chambers are in the form of channels and include at least channel portions arranged parallel to said sample preparation channel and adjacent to one another.

4. A microfluidic device according to claim 1, wherein said structure comprises a structural layer, formed on said body and made of a polymeric material, and a cap layer bonded to said structural layer.

5. A microfluidic device according to claim 1, wherein said at least one superficial sealed chamber is further delimited by said body.

6. A micro fluidic device according to claim 1, wherein said at least one superficial sealed chamber is external to said monolithic semiconductor body.

7. A microfluidic device according to claim 1, wherein said sample preparation channel is delimited by said structural layer and by said cap layer.

8. A microfluidic device according to claim 1, wherein said sealed chambers include a plurality of buried chambers formed inside said body.

9. A micro fluidic device according to claim 8, wherein said buried chambers are arranged parallel and adjacent to said microfluidic channel.

10. A micro fluidic device according to claim 1, wherein said openable sealing elements include respective dielectric diaphragms arranged to fluidly isolate said sealed chambers from said microfluidic circuit and said micropump includes electrical opening means associated with said sealing elements for electrically breaking said dielectric diaphragms.

11. A microfluidic device according to claim 10, wherein said electrical opening means include first and second electrodes arranged on opposite sides of respective said openable sealing elements to form respective capacitors therewith.

12. A microfluidic device according to claim 11, wherein said first and second electrodes are configured to allow air passage between said sealed chambers and said microfluidic circuit when the respective openable sealing elements are opened.

13. A micro fluidic device according to claim 1, wherein said sealing elements include respective conductive diaphragms.

14. A micro fluidic device according to claim 1, wherein said first pressure is lower than said second pressure.

15. A microfluidic device according to claim 1, wherein said first pressure is higher than said second pressure.

16. A process for manufacturing a micro fluidic device for nucleic acid analysis, comprising the steps of:

a) forming a microfluidic circuit at least partially accommodated in a monolithic semiconductor body, wherein said microfluidic circuit includes a sample preparation channel formed on said monolithic semiconductor body and at least one microfluidic channel buried in said monolithic semiconductor body; and b) forming a micropump, having a plurality of sealed chambers provided with respective openable sealing elements and having a first pressure therein that is different from a second pressure in said microfluidic circuit, wherein said micropump and said microfluidic circuit are configured so that opening said openable sealing elements provides fluidic coupling between the respective sealed chambers and said microfluidic circuit;

wherein said step of forming a micropump comprises i) forming a structure on said monolithic semiconductor body and at least one superficial sealed chamber in said structure, above said monolithic semiconductor body and integrating said openable sealing elements in said body; and ii) forming at least one buried chamber inside said body;

wherein groups of alternating buried chambers and superficial sealed chambers are series connectable through connecting passages reversibly closed by respective openable sealing elements and wherein one superficial sealed chamber in each group is connectable to said microfluidic circuit.

17. A process according to claim 16, wherein said first pressure is lower than said second pressure and said at least one superficial sealed chamber is formed under predetermined low pressure conditions.

18. A process according to claim 17, wherein the step of forming said structure and at least one superficial sealed chamber in said structure comprises:

depositing a structural layer of a polymeric material on said body;

selectively etching said structural layer to laterally define said at least one superficial sealed chamber; and bonding a cap layer to said structural layer under said predetermined low pressure conditions.

19. A process according to claim 16, wherein said step of forming said microfluidic circuit comprises opening passages for connecting said microfluidic circuit to said micropump, wherein said openable sealing elements are formed at ends of said passages before forming said structure.

20. A process according to claim 16, comprising the step of forming a hard mask on a substrate of said body, and etching said substrate using said hard mask to create said at least one microfluidic channel and said at least one buried chamber.

21. A process according to claim 16, wherein said first pressure is higher than said second pressure and said at least one sealed superficial chamber is formed under predetermined high pressure conditions.

* * * * *